United States Patent [19]

Schwadtke et al.

[11] 4,167,594

[45] Sep. 11, 1979

[54] COMBINED LAUNDRY FINISHING TREATMENT AGENT PACKAGE AND METHOD

[75] Inventors: Karl Schwadtke, Leverkusen; Werner Künzel, Langenfeld; Rudolf Weber, Dusseldorf; Rolf Puchta, Haan; Alexander Cioc, Dusseldorf; Michael Kik, Langenfeld, all of Fed. Rep. of Germany

[73] Assignee: Henkel Kommanditgesellschaft auf Aktien(Henkel KGaA), Dusseldorf, Fed. Rep. of Germany

[21] Appl. No.: 864,460

[22] Filed: Dec. 27, 1977

[30] Foreign Application Priority Data

Dec. 27, 1976 [DE] Fed. Rep. of Germany ..... 2658989

[51] Int. Cl.[2] ..... B05D 3/12

[52] U.S. Cl. ..... 427/242; 34/9; 34/12; 34/60; 34/72; 206/0.5

[58] Field of Search ..... 206/0.5; 239/55, 57, 239/58; 34/72, 9, 12, 60; 427/242; 222/54

[56] References Cited

U.S. PATENT DOCUMENTS

| | | | |
|---|---|---|---|
| 3,279,118 | 10/1966 | Allen | 239/57 X |
| 3,310,235 | 3/1967 | Zbunden | 239/55 X |
| 3,459,117 | 8/1969 | Koon et al. | 206/0.5 |
| 3,706,140 | 12/1972 | Brillaud et al. | 239/55 X |
| 4,014,432 | 3/1977 | Clothier et al. | 427/242 X |

*Primary Examiner*—Evan K. Lawrence

*Attorney, Agent, or Firm*—Hammond & Littell

[57] ABSTRACT

A laundry finishing treatment article for use in a mechanical laundry drier to treat fabrics with a substance of the laundry finishing type and a laundry odorant, the article comprising a hollow bag of two-layer composite sheeting having a pillowlike form closed on all sides, the external layer of said two-layer composite sheeting being an open-celled absorbent layer containing an amount effective to treat said fabrics of the substance, which substance is substantially solid at room temperature and softened or liquefied at elevated drier temperatures to enable a transfer of the substance to the laundry during the drying thereof, and the internal layer of the two-layer composite sheeting being a plastic film substantially gas-impermeable at room temperature and gas-permeable to the odorant at elevated drier temperatures, the film enclosing an effective amount of the odorant; as well as the process for after-treating laundry in a drier in which the above laundry finishing treatment article is introduced into a drier together with moist laundry and allowed to act on the laundry during the drying process.

22 Claims, 2 Drawing Figures

COMBINED LAUNDRY FINISHING TREATMENT AGENT PACKAGE AND METHOD

BACKGROUND OF THE INVENTION

During the washing process of laundry in mechanical washing machines the laundry is first washed with water containing detergent and then drained and rinsed one or several times with rinse water. This rinse treatment is usually of a short duration. During this rinsing treatment use is frequently made, particularly in the last rinse step, of agents which are intended to impart improved properties to the washed laundry, such as a soft and fleecy feel, antistatic behavior, an antimicrobe protection and a pleasant smell. In order to be suitable for these finishing treatment methods, these agents must not only become uniformly distributed in the cold rinsing bath, but also become exhausted in a short time from the bath onto the textiles. Useful products are indeed on the market, which impart to the laundry in the last rinsing bath the desired, predominantly softening and antistatic properties, but all the items of laundry are uniformly affected by this type of treatment, so that the laundry must be sorted out already before washing with a view toward the finishing treatment. Moreover, care must be taken with this method that the finishing treatment agent is introduced into the washing machine at the correct time or through a special metering device and without contact with the actual washing agent.

A further disadvantage of the known laundry finishing treatment agents is that they can be made up only as highly diluted, aqueous suspensions, since stability during storage, ease of pouring and rapid distribution in the cold rinsing water is assured only when the effective substances are present in a dilution of 10 to 20 times, which leads to relatively high costs for packaging and transportation. Substances which are insoluble in cold water are just as poorly suited for this kind of laundry treatment as those which possess no specific affinity for the textile fiber surface, both are poorly exhausted from the rinse water and, consequently, with the used rinsing water, are passed to the sewer system. Therefore, the number of usable effective substances is limited.

With the steadily increasing use of laundry drying machines in industrial laundries and in private households, because of the saving in space and time in laundry drying afforded by such use by comparison with hanging the laundry on a line to dry, new possibilities now arise for moving the process of laundry finishing treatment to the drier itself and carrying it out simultaneously with the drying of the laundry. Recently, a series of proposals have, therefore, been made as to how known and new effective substances can be applied to the finishing treatment of laundry in the laundry drier. Among these proposals are the use of textile or paper webs which are impregnated with the effective substance, as described in U.S. Pat. Nos. 3,632,396, 3,686,025 and 3,743,534, and the use of foaming or non-foaming aerosol mixtures, with which the effective substances are sprayed onto the internal wall of the drier or onto the moist textile articles.

Furthermore, the use of perforated hollow objects, which contain a solution of the effective substance and which are tumbled in the laundry drier together with the laundry, as described in U.S. Pat. No. 4,014,105, and of solid, pelletized mixtures of the effective substances with soluble carrier substances, which are to be absorbed during the drying process onto the textile surface, has also been discussed. These forms of application of the state of the art are, however, accompanied by a series of disadvantages. Thus, for example, a non-uniform distribution and a consequent forming of stains on the laundry are observed in the use of solid textile softeners. Even with the perforated hollow articles filled with liquid finishing treatment agents, the problem of the uniform distribution of the effective substances is not solved, added to which are the further disadvantages of the cumbersomeness of these articles and the difficulty of metering the effective substances. With the use of the agent in spray form, undesired precipitations frequently form on the equipment parts important for correct functioning of the laundry drier equipment, such as, for example, the temperature and humidity sensors. With the sheets of paper, woven or non-woven fabric impregnated with the effective substance, it is to be observed that the effective substance adhering to the substrate, which should become detached from the substrate and absorbed onto the textile to be dried, is only incompletely given off due to the fact that these structures, which have a large surface area, tend to cling to the wall of the dryer drum or to a piece of the laundry, which also imposes a limit upon the effectiveness of this form of application.

U.S. Pat. No. 3,701,202 discloses another method of distributing liquid textile treating agents in a drum dryer which comprises a container with a porous outlet which is clamped in the rotatable drum. This likewise creates problems of uneven distribution of the treating agents and involves the additional problem of detaching and replacing the container after each operation or after several operations, in order to fill the same.

Another commercial development of the same nature is the use of a porous container which has a self-adhering side, which is attached to the wall of the dryer drum, as is described in U.S. Pat. No. 4,004,685. This type of device presents the problem of even application of the treating agents to the goods, particularly since the commercial embodiment is designed to be used over a series of drier cycles.

U.S. Pat. No. 3,989,638 likewise is directed to the problem and discloses the use of articles releasably containing starch-thickened peroxygen bleaches for use in machine laundry driers. Patentee employs articles having perforations in the range of 0.05 to about 3 mm in order that his thickened bleaches can be released at the proper rate, since moisture must be present to effect the bleaching action. This device suffers the drawback that the amount of bleach being dispensed at the onset will depend on the temperature of the bleach package storage since the viscosity of the starch thickened bleach is dependent on viscosity. Moreover, such an article must be covered until the time of use and care must be taken to avoid loss of bleach from the article before inserting the same into the dryer.

SUMMARY OF THE INVENTION

An object of the present invention is the development of a laundry finishing treatment agent which is suitable for use in a mechanical laundry drier and in the form of a dispensing device charged with effective substances.

Another object of the present invention is the development of a laundry finishing treatment article for use in a mechanical laundry drier to treat fabrics with a substance of the laundry finishing type and a laundry odorant, said article comprising a hollow bag of two-layer composite sheeting having a pillowlike form closed on all sides, the external layer of said two-layer composite sheeting being an open-celled absorbent layer containing an amount effective to treat said fabrics of said substance, which substance is substantially solid at room temperature and softened or liquefied at elevated drier temperatures to enable a transfer of said substance to the laundry during the drying thereof, and the internal layer of the two-layer composite sheeting being a plastic film substantially gas-impermeable at room temperature and gas-permeable to said odorant at elevated drier temperatures, said film enclosing an effective amount of said odorant.

A further object of the present invention is the development of a process for the production of the above laundry finishing treatment agent for use in a mechanical laundry drier.

These and other objects of the invention will become more apparent as the description thereof proceeds.

DESCRIPTION OF THE PREFERRED EMBODIMENTS

Figure 1:
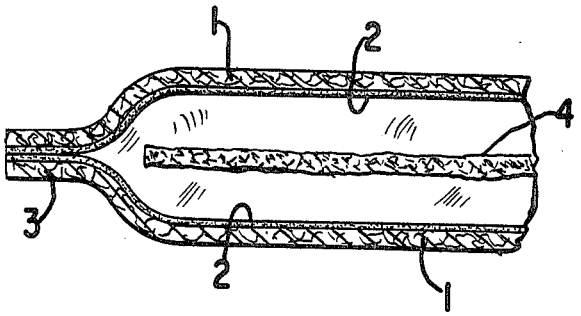
FIG. 1 is a cross-sectional view of the laundry finishing treatment bag of the invention.

By the present invention the above disadvantages of the known laundry after-treatments have been reduced or substantially obviated and the above objects have been achieved.

According to the present invention, the problems of the prior art have been reduced or substantially solved by means of a device which consists of a bag or sachet closed on all sides which is formed from a two-layered composite sheet, the external surfaces of which bag are formed by a porous, absorbent sheet charged with antistatic treatment substances, and the internal surfaces of which bag are formed by a sheet which is virtually impermeable to perfume at room temperature but permeable to perfume at the elevated temperature of the drier, the perfumes being situated inside the bag.

More particularly, the present invention relates to a laundry finishing treatment article for use in a mechanical laundry drier comprising a hollow bag of two-layer composite sheeting having a pillowlike form closed on all sides, the external surface of said two-layer composite sheeting being a porous, absorbent layer containing an effective amount of effective substance of the laundry finishing treatment type which is substantially solid at room temperature, and the internal surface of the two-layer composite being a plastic film substantially gas-impermeable at room temperature and gas-permeable at elevated drier temperatures, said article containing an effective amount of a laundry odorant within said gas-impermeable at room temperature pillowlike form.

The device according to the invention will hereinafter be referred to as a "conditioner bag" for the sake of simplicity.

The material used for constructing the conditioner bag is a composite sheet consisting of two layers, the inner of which is a thin sheet which is virtually gas-impermeable at room temperature, particularly to laundry odorants or perfumes, but gas-permeable, particularly to laundry odorants or perfumes, at elevated temperatures, such as between 35° C. and 100° C., but particularly at the temperatures of around 60° C. at which mechanical laundry driers operate, while the external layer of the two-layer composite material is a porous, absorbent sheet, particularly an open-celled foam plastic sheet.

Suitable sheets which are gas-impermeable to perfume at room temperature and become gas-permeable to the perfume at elevated temperatures have a thickness of from 0.03 to 0.15 mm, preferably from 0.05 to 0.08 mm. The preferred material for this sheet is polyethylene.

The external sheet of the two-layer composite material, which is the one carrying the active substance, consists of an open-celled foam and has a thickness of from 0.5 to 3 mm, preferably from 1.0 to 2.5 mm. The density of suitable foams is from 0.005 t 0.05, preferably from 0.01 to 0.04, gm/cm$^3$.

The composite sheet for the conditioner bag may also consist of a structured foam sheet one side of which, in case of the device according to the invention the external side, consists of a porous, open-celled foam which is impregnated with the active substance while the other side consists of a thin, completely non-cellular skin, corresponding to the thin sheet, which is virtually impermeable to perfume at room temperature and permeable to the perfumes at elevated temperature.

This composite sheet could in principle consist of any materials which are stable under the operating conditions of a laundry drier, i.e., high humidity and at temperatures of up to about 100° C., and which are inert towards the active substances and perfumes with which they come into contact. Suitable materials for the foam sheet include, for example, foamed cellulose acetate, viscose cellulose, polyvinyl chloride, polyolefin, polyamide, copolymers of acrylonitrile, butadiene and styrene, natural and synthetic rubber and, particularly polyurethane.

The preferred polyurethane foams are produced in known manner by the reaction of diisocyanates with polyether or polyester polyols. The reaction mixtures are in this case foamed up by the addition of water to the excess isocyanate, optionally in the presence of foaming agents, so that carbon dioxide is released, which causes the formation of foam.

The bag which carries the active substances and contains the perfume is preferably in the form of a sachet, the edges of which run round the periphery of the sachet and are sealed together on all sides by gluing or welding of the substance.

The device according to the invention is preferably rectangular or square in top plan view with sides measuring from 5 to 30 cm but it may also be circular, elliptic, oval or polygonal or have any irregular shape.

Figure 2:
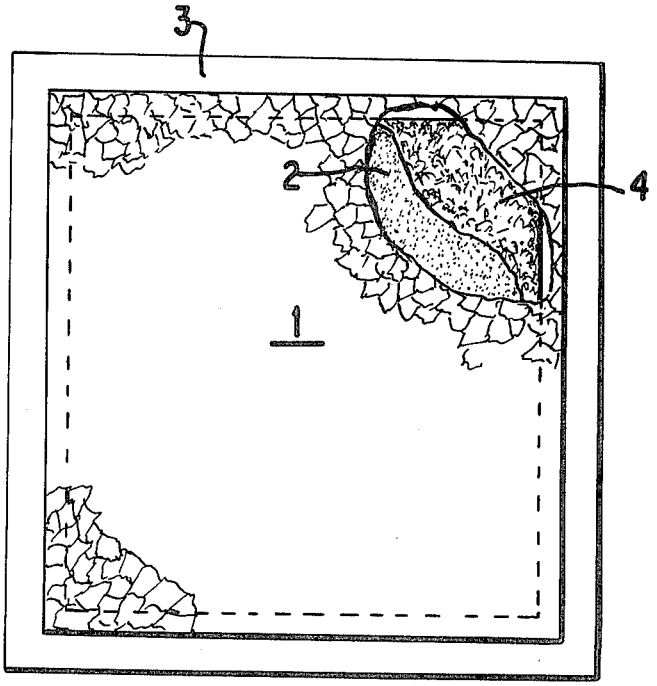
FIG. 2 is a top plan view of the laundry finishing treatment bag of the invention.

Other details of the device according to the invention will be explained below with reference to the accompanying schematic drawings. FIG. 1 is a cross-section through the conditioner bag; FIG. 2 is a top plan view of the conditioner bag in the preferred form of a sachet.

In FIGS. 1 and 2, layer 1 is the external sheet of open-celled foam resin, preferably polyurethane foam, which is impregnated with the active laundry finishing treatment substances. Together with the thin, internal sheet 2, which may, for example, consist of polyethylene or may be the closed skin of a structured foam sheet, it forms the composite material. The two sheets together enclose the absorbent perfume carrier material 4 e.g., a non-woven web, and are sealed together along the edge 3 of the sachet, in particular by gluing or welding. If they are joined together by gluing, the thickness of the edge 3 is the sum of the thicknesses of the two sheets which are glued together and the layer of adhesive, whereas if they are welded together, the sheets of foam 1 become compressed and, therefore, thinner. The internal layer 2 is usually loosely applied to the perfume-impregnated carrier material 4.

Rapid and uniform distribution of the effective substances are required where the same are textile fabric softeners and/or textile antistatic agents, either with or without disinfectant agents or antimicrobials. However, rapid distribution of any laundry odorant present is not as desirable since prolonged exposure of the usual laundry odorants to heat and moisture results in a large loss of the same due to evaporation and possibly a type of steam distillation. Therefore, the odorant is maintained in a gas-impermeable envelope.

The active substances which may be used for impregnating the conditioner bag are, in particular, textile softeners and antistatic treatment substances for textiles. Antimicrobial agents, soil release substances, ironing aids, impregnating substances, flame retarding agents and moth-proofing agents may also be used. The substances may be used individually or as mixtures.

Suitable textile softeners are quaternary ammonium compounds preferably having two long chains, preferably saturated aliphatic groups each containing from 14 to 26, preferably from 16 to 20, carbon atoms, with at least one quaternary nitrogen atom in the molecule. The long chain aliphatic groups may be straight or branched chain and hence may be derived from fatty acids or fatty amines, Guerbet derived amines, or from alkylamines obtained by the reduction of nitroparaffins. These quaternary ammonium compounds are mainly derivatives of ammonia, i.e., quaternary salts obtained by the alkylation of long chain secondary amines, e.g., the compounds distearyldimethylammonium chloride or ditallow alkyldimethylammonium chloride, or imidazoline compounds which can be obtained by reacting one mol of an aminoalkylethylenediamine or hydroxylalkylethylenediamine with 2 mols of a long chain $C_{12-26}$ fatty acid or an ester thereof, and which are subsequently converted into the quaternary imidazolinium compounds by alkylation. In these quaternary ammonium compounds, the anion is generally an acid group obtained from the alkylating agent used for quaternization. The anion may, therefore, be, for example, chloride, bromide, methyl sulfate, ethyl sulfate or methane, ethane or toluene sulfonate.

Preferably employed quaternary ammonium compounds have the formula:

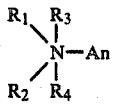

wherein $R_1$ and $R_2$ are selected from the group consisting of alkyl having from 14 to 26 carbon atoms and alkenyl having from 14 to 26 carbon atoms, $R_3$ and $R_4$ are selected from the group consisting of alkyl having 1 to 4 carbon atoms and alkylol having from 2 to 4 carbon atoms and An is an anion selected from the group consisting of halide, lower alkyl sulfate, lower alkyl sulfonate, phenyl sulfonate and lower alkylphenyl sulfonate.

In addition to these quaternary ammonium compounds, the condensation products of 1 to 3 mols of a fatty acid or fatty acid alkyl ester or one third to one mol of fatty acid triglyceride with one mol of a hydroxyalkyl polyamine, for example, hydroxyethyl ethylenediamine or hydroxyethyl diethylenetriamine may be used also as fabric softeners. The product obtained by the reaction of one mol of a fatty acid triglyceride, in particular, hardened tallow, with one mol of hydroxyethyl ethylenediamine at 90° to 150° C. is particularly suitable. The preferred textile softener is a combination of a quaternary ammomium compound of the ammonia series having two $C_{16}$-$C_{20}$ alkyl or alkenyl groups and two methyl groups in the molecule and a chloride, bromide or methyl sulfate anion, in particular ditallow alkyldimethylammonium chloride, with the fatty acid condensation product of one mol of hardened tallow and one mol of hydroxyethyl ethylenediamine, used in proportions of between 4:1 and 1:4. Textiles treated with these combinations show a marked and uniform improvement in their handle without any stain buildup.

The antistatic treatment substances are generally the same or similar types of compounds to those used as fabric softeners. Apart from the quaternary ammonium compounds and fatty acid condensation products described above, quaternary ammonium compounds containing one long chain and three short chain aliphatic groups may also be used as textile antistatic treatment substances. Other suitable antistatic agents are, for example, the reaction products of one mol of an aliphatic $C_6$-$C_{20}$ alcohol and more than 20 mols, preferably 35 to 50 mols, of ethylene oxide.

Suitable antimicrobial treatment substances, i.e., compounds which have a bactericidal or bacteriostatic or fungicidal or fungistatic action, are in most cases also quaternary ammonium compounds, particularly those which, in addition to one long chain aliphatic and two short chain aliphatic hydrocarbon groups contain an aromatic group which is attached to the nitrogen atom through an aliphatic carbon atom, or an aliphatic organic group which contains double bonds. Typical representatives of such antimicrobial active substances are the compounds, dimethyl-benzyl-dodecylammonium chloride, dibutyl-allyl-dodecylammonium chloride and ethyl-cyclohexyl-allyl-dodecylammonium chloride. Bromonitroalcohols are also suitable antimicrobial substances, for example, the compounds, 2-bromo-2-nitropropane-1,3-diol, 1-bromo-1-nitro-3,3-trichloro-2-propanol and 2-bromo-2-nitrobutanol. Halogenated and/or trifluoromethyl-substituted phenolic compounds are also suitable antimicrobial substances, particularly the halogenated salicylanilides, e.g., the compounds, dibromo-salicylanilide and tribromo-salicylanilide, and derivatives of p-phenoxyphenol, such as the compound, 2-hydroxy-2'-4,4'-trichlorodiphenylether.

Suitable active substances for use as soil release finishes for textiles are compounds which allow the dirt to be more easily released from the laundry during the washing process. These include compounds, such as polyacrylpolyvinyl alcohols, modified fluorinated hydrocarbons and hydrophilic polymers. Polyvinyl acetates and borax are suitable additives which make the laundry easier to iron.

The conditioner bag generally contains from 0.5 to 10 gm, preferably from 1 to 5 gm, of active substance per $dm^2$ of the surface area of the foam.

The device according to the invention preferably contains the perfumes bound to an absorbent carrier material. Suitable carrier materials are fleeces, e.g., polyamide, polyvinyl chloride or on a cellulose basis, felt, paper, foam plastics, sponges or textile materials.

The fleeces are preferably cut to the size and shape of the sachets.

The perfume may be used in its pure form, as an alcohol solution or as an aqueous emulsion. It is preferably used as an emulsion, i.e., as a mixture of perfume oil, water and an emulsifier. Any types of perfumes which produce the desired aroma and are stable under the conditions of use are suitable. Preferably the desired aroma is one promoting the impression of cleanliness and freshness to the dried laundry. Flowery-scented essences are mostly selected as perfume oils for this.

Suitable perfume emulsifiers are hydrophilic surface-active substances (nonionic surface-active compounds), such as hydrogenated castor oil adducted with 40 mols of ethylene oxide or coconut alkyl alcohol adducted with 4 mols of ethylene oxide.

The sheets which form the bag are preferably joined together by welding but they may also be glued together. If the bag is in the form of a pouch, it may also be sewn or tied with binding thread or closed with metal wire or plastic fasteners or other possible closing devices.

The conditioner bag according to the invention is preferably rectangular or square with a length of side of from 5 to 30 cm, as already mentioned above. The thickness is from 0.15 to 1 cm. The edge 3 in FIGS. 1 and 2 has a width of from 0.1 to 1.5 cm.

A typical example of the device according to the invention as shown in FIGS. 1 and 2 is square with a length of side of 10 cm. The preferred weight of the finished conditioner sachet is 12.7 gm, of which 5 gm are contributed by the active substance and 4 gm by the perfume oil emulsion containing 40% of perfume oil. The carrier 4 for the perfume oil emulsion weighs approximately 3.0 gm and the enveloping sheet material 1 and 2, 0.7 gm.

For use in standard domestic laundry driers, the size of the conditioner bag is generally calculated so that the active substances and perfumes supplied from it are sufficient for conditioning the usual quantity of laundry taken by a conventional domestic laundry drier, i.e., about 2 to 3 kg of dry weight of laundry. This requires about 0.5 to 5 gm of textile softener or antistatic treatment substances, which is the amount given off by a surface area of sachet of from 0.2 to 2 $dm^2$. It is, of course, also possible to use more than one conditioner bag for one conditioning process, and a conditioner bag may also be used more than once if the active ingredients are not completely removed in one operation, e.g., if the drier is not fully loaded.

The conditioner bags used for driers in industrial laundries have a larger surface area to correspond to the greater capacity of the driers of up to about 50 kg; for example, they may have a surface area of 18 $dm^2$, and they are more heavily loaded with active substances.

The invention also relates to a process for the manufacture of the devices. In this process a piece of absorbent carrier material, if desired, folded together, is inserted in the bag formed from the composite sheet material, preferably from two identical pieces of this material, the carrier material being impregnated with pure perfume or a solution or emlusion of the perfume either before or after it is inserted into the bag, and the bag is then sealed on all sides. The bag is then immersed in a solution, solvent-free melt, or a dispersion of the active substances. If a solution or dispersion is used, the solvent or dispersing agent must subsequently be removed by drying with hot or cold air. If a melt is used, the active substances are preferably solidified by cooling with cold air. From 0.5 to 10 gm, preferably from 1 to 5 gm, of active substance per $dm^2$ are absorbed in the impregnating process.

The invention also relates to a process for the after-treatment of washed laundry in a laundry drier. In this process, the laundry is introduced into the drum of the drier together with the device according to the invention. During the drying process, the conditioner sachet moves in a similar manner to the pieces of laundry and thus comes into repeated and close contact with the laundry so that the active substances, which are softened or liquefied at the temperatures of the drier, are uniformly transferred from the device to the pieces of laundry. The perfume substances pass through the internal layer of the bag, which sheet has become permeable at the elevated temperature, and are also fixed on the pieces of laundry. It was particularly surprising to observe that a substantial proportion of the perfume substances finally found on the laundry was deposited only during the cold phase following the hot phase of drying.

The following examples are illustrative of the practice of the invention without being limitative. EXAMPLES These Examples describe the manufacture and functioning of a device according to the invention produced for a standard domestic drier.

EXAMPLE 1

A paper fleece measuring 21×21 cm (weight approximately 70 $gm/m^2$) was folded into nine layers measuring approximately 7×7 cm and impregnated with 5 ml of a perfume oil emulsion of 40 parts by weight of perfume oil, 5 parts by weight of emulsifier (coconut fatty alcohol ethoxylated with 4 mols of ethylene oxide) and 55 parts by weight of water.

The perfume oil employed was a fragrance which can be described as "flowery fancy lavender with a radiant fresh headnote" and had the following composition:

| | Percent by weight |
|---|---|
| Lavender oil 40/42% | 350 |
| Lavendin oil 30/32% | 280 |
| Italian lemon oil | 100 |
| Rosemary oil | 80 |
| Geranium oil | 50 |
| Terpineol (perfumery) | 50 |
| α-Hexyl cinnamaldehyde | 50 |
| Patchouli oil Karimun | 20 |
| Ketone musk | 20 |

The impregnated fleece was then sealed in between two pieces of two-layer composite sheet each measuring 10×10 cm, consisting of a polyethylene sheet 0.8 mm in thickness and a foam sheet of polyether-polyurethane foam (density 0.019 $gm/cm^3$) 1.5 mm in thickness, the foam sheet being situated on the outside of the two-layer composite. The welding edge of the sachet was approximately 0.5 cm in width. The sealed sachet was dipped for about 7 seconds into a solution (temperature 35° C.) of 50 parts by weight of ditallow alkyl-dimethylammonium chloride and 50 parts by weight of isopropanol and dried at room temperature. The sheet of foam had absorbed approximately 5 gm of active substance. The total weight of the device was finally approximately 12.5 gm.

This sachet was added to a loading of moist washed laundry (dry weight: 2.8 kg: one third Turkish towelling and two thirds plain cotton goods) together with test strips of polyester/cotton 65:35 in a conventional moisture controlled drier and the washing was dried with the program "extra dry". The scent, handle and change in electrostatic properties were then determined. The electrostatic properties were determined on the test strips, using a static voltmeter R 1020 manufactured by Rothschild, Zurich, Switzerland.

The finished laundry showed a marked improvement in handle, a pleasant scent and excellent electrostatic properties, compared with untreated laundry.

EXAMPLE 2

Two pieces of structured foam foil (density 0.035 gm/cm$^3$) 0.15 mm in thickness and measuring 12×12 cm were placed with their non-cellular surfaces in contact with each other and sealed together along three of the four edges. A fleece of viscose measuring 10×10 cm was then pushed between the two pieces and impregnated with 4 ml of a perfume oil emulsion of 40 parts by weight of perfume oil, 5 parts by weight of a hydrogenated castor oil adducted with 40 mols of ethylene oxide and 55 parts by weight of water by means of a pipette. When the fourth edge had been sealed up, the sachet was impregnated with a mixture, which had been melted at 80° C., of 50 parts by weight of ditallow alkyldimethylammonium chloride in the form of a 75% paste, the remainder consisting of isopropyl alcohol and 50 parts by weight of a condensation product of 1 mol of hardened tallow and 1 mol of hydroxyethyl ethylenediamine. The device was then weighed after it had been cooled in a stream of cold air. It was found to weigh 13.8 gm, 8.2 gm of which was active substance.

When this device was used and tested as in Example 1, it was found to produce a marked improvement in handle, a more rapid destruction of static charge and a pronounced scent.

The preceding specific embodiments are illustrative of the practice of the invention. It is to be understood, however, that other expedients known to those skilled in the art or disclosed herein, may be employed without departing from the spirit of the invention and the scope of the appended claims.

We claim:

1. A laundry finishing treatment article for use in a mechanical laundry drier to treat fabrics with a substance of the laundry finishing type and a laundry odorant, said article comprising a hollow bag of two-layer composite sheeting having a pillowlike form closed on all sides, the external layer of said two-layer composite sheeting being an open-celled, absorbent layer containing an amount effective to treat said fabrics of said substance, which substance is substantially solid at room temperature and softened or liquefied at elevated drier temperatures to enable transfer of said substance to the laundry during the drying thereof, and the internal layer of the two-layer composite sheeting being a plastic film substantially gas-impermeable at room temperature and gas-permeable to said odorant at elevated drier temperatures, said film enclosing an effective amount of said odorant.

2. The laundry finishing treatment article of claim 1 wherein said article is rectangular, having side lengths of from 5 to 30 cm and being sealed on all four sides.

3. The laundry finishing treatment article of claim 2 wherein said article is substantially square and sealed on all four sides by glue.

4. The laundry finishing treatment article of claim 2 wherein said article is substantially square and sealed on all four sides by welding.

5. The laundry finishing treatment article of claim 1 wherein said substance of the laundry finishing type is selected from the group consisting of textile fabric softerners, textile antistatic agents, antimicrobial agents, soil release agents, ironing aids, flame retardants and moth proofing agents.

6. The laundry finishing treatment article of claim 1 wherein said absorbent layer is a discrete layer of a foamed plastic.

7. The laundry finishing treatment article of claim 1 wherein said plastic film is a discrete layer having a thickness of from 0.03 to 0.15 mm.

8. The laundry finishing treatment article of claim 1 wherein said plastic film is a discrete layer having a thickness of from 0.05 to 0.08 mm.

9. The laundry finishing treatment article of claim 8 wherein said plastic film is a polyethylene film.

10. The laundry finishing treatment article of claim 1 wherein said two-layer composite sheeting is a single sheet having a foamed open-celled plastic external layer and an integral internal layer of a gas-impermeable at room temperature plastic non-cellular skin.

11. The laundry finishing treatment article of claim 6 wherein said foamed plastic is foamed polyurethane having a thickness of 0.5 to 3 mm.

12. The laundry finishing treatment article of claim 6 wherein said foamed plastic is foamed polyurethane having a thickness of 1.0 to 2.5 mm.

13. The laundry finishing treatment article of claim 10 wherein said foamed plastic is foamed polyurethane having a thickness of 0.5 to 3 mm.

14. The laundry finishing treatment article of claim 10 wherein said foamed plastic is foamed polyurethane having a thickness of 1.0 to 2.5 mm.

15. The laundry finishing treatment article of claim 1 wherein said absorbent layer contains from 0.5 to 10 gm of said substance per dm$^2$ of surface.

16. The laundry finishing treatment article of claim 1 wherein said absorbent layer contains from 1 to 5 gm of said substance per dm$^2$ of surface.

17. The laundry finishing treatment article of claim 1 wherein said absorbent layer has a density of from 0.005 to 0.05 gm/cm$^3$.

18. The laundry finishing treatment article of claim 1 wherein said absorbent layer has a density of from 0.01 to 0.04 gm/cm$^3$.

19. The laundry finishing treatment article of claim 6 wherein said foamed plastic is selected from the group consisting of cellulose acetate, viscose cellulose, polyvinyl chloride, polyolefin, polyamide, copolymers of acrylonitrile, butadiene and styrene, natural rubber, synthetic rubber and polyurethane.

20. The laundry finishing treatment article of claim 1 wherein said substance is selected from the group consisting of:

(1) a quaternary ammonium compound having two $C_{16}$–$C_{20}$ alkyl groups and two methyl groups in the molecule and a chloride, bromide or methyl sulfate anion, alone, and (2) a mixture of said quaternary ammonium compound with the condensation product of one mol of hardened tallow and one mol of hydroxyethylethylenediamine in proportions of from 4:1 to 1:4.

21. The laundry finishing treatment article of claim 20 wherein said quaternary ammonium compound is ditallow alkyl-dimethylammonium chloride.

22. A process for after-treating laundry in a drier in which the laundry finishing treatment article of claim 1 is introduced into a drier together with moist laundry and left to act on the laundry during the drying process.

* * * * *